US006360574B1

(12) United States Patent
Vodopyanov

(10) Patent No.: US 6,360,574 B1
(45) Date of Patent: Mar. 26, 2002

(54) FILLET ROLLING WORK ROLLER CAGE

(75) Inventor: Eugene Vodopyanov, Oak Park, MI (US)

(73) Assignee: Hegenscheidt-MFD Corporation, Sterling Heights, MI (US)

( * ) Notice: Subject to any disclaimer, the term of this patent is extended or adjusted under 35 U.S.C. 154(b) by 0 days.

(21) Appl. No.: 09/664,033

(22) Filed: Sep. 18, 2000

(51) Int. Cl.[7] ..... B21D 15/00

(52) U.S. Cl. ..... 72/110; 72/107; 29/6.01; 384/623

(58) Field of Search ..... 29/888.08, 6.01; 72/107, 110; 384/623

(56) References Cited

U.S. PATENT DOCUMENTS 5,575,167 A * 11/1996 Gottschalk et al. ..... 72/110
5,575,570 A * 11/1996 Uchiyama et al. ..... 384/470
5,822,861 A * 10/1998 Tadic et al. ..... 29/898.064
6,094,956 A * 8/2000 Vodopyanov et al. ..... 72/110
6,102,580 A * 8/2000 Alling et al. ..... 384/618

* cited by examiner

*Primary Examiner*—Ed Tolan
(74) *Attorney, Agent, or Firm*—Carlson, Gaskey & Olds

(57) ABSTRACT

A fillet rolling tool for deep rolling journal fillets is provided. The tool includes a housing assembly having a cavity. A backup roller having an annular groove is disposed in the cavity and is rotatably supported by the housing assembly. A work roller is received in the annular cavity for deep rolling journal fillets. At least one cage, construction from a polymer material, has an arcuate recess that receives the work roller. The cage includes an outer wall that defines a portion of the arcuate recess. Preferably the polymer is a thermal plastic such as a high density polyethylene. Most preferably, the polymer is an ultra high molecular weight polyethylene. The polymer of the present invention has a ductility, an impact strength, and a wear resistance that is superior to those of bronze. Accordingly, the polymer cage of the present invention does not fracture as easily as bronze under the lateral forces of the fillet rolling process.

16 Claims, 3 Drawing Sheets

FILLET ROLLING WORK ROLLER CAGE

BACKGROUND OF THE INVENTION

This invention relates to a fillet rolling tool for deep rolling journal fillets, and more particularly, the invention relates to an improved work roller cage for the fillet rolling tool.

Deep rolling has been used for many years to strengthen the journal fillets of components such as engine crankshafts. The fillets are mechanically worked and plastically deformed by a rolling tool to strengthen the fillets and relieve stress in the area of the fillets. Typically, a pair of opposing work tools are used to roll the journal fillets. One tool includes a pair of rollers to support the lower portion of the journal while an upper tool containing at least one work roller is used to engage the journal fillet and mechanically work the fillet area. The upper and lower work tools are actuated towards one another using a hydraulic cylinder to apply pressure in the area of the journal fillet. The work piece, such as a crankshaft, is driven along its axis to roll the journal fillets. The work roller is subjected to several thousand pounds of force during the deep rolling process.

The work rollers are supported on the upper work tool by cages that retain the work rollers. The cages have arcuate recesses that are defined by inner and outer walls and receive the work roller. The work rollers are permitted to float laterally to compensate for tolerances in the crankshaft. For at least the last several decades the cages have been constructed from bronze. During the deep fillet rolling process due to the lateral motion of the work roller within arcuate recess of the cage, the outer wall of the cage may fracture thus necessitating replacement of the cage. As a result, production of crankshafts must be interrupted so that the upper work tool may be removed and the cage replaced. Therefore, it is desirable to provide an improved cage that does not fracture during lateral movement of the work rollers within the cage.

SUMMARY OF THE INVENTION AND ADVANTAGES

The present invention provides a fillet rolling tool for deep rolling journal fillets. The tool includes a housing assembly having a cavity. A backup roller having an annular groove is disposed in the cavity and is rotatably supported by the housing assembly. A work roller is received in the annular cavity for deep rolling journal fillets. At least one cage, constructed from a polymer material, has an arcuate recess that receives the work roller. The cage includes an outer wall that defines a portion of the arcuate recess. Preferably, the polymer is a thermoplastic such as a high density polyethylene. Most preferably, the polymer is an ultra high molecular weight polyethylene. The polymer of the present invention has a ductility, an impact strength, and a wear resistance that is superior to those of bronze. Accordingly, the polymer cage of the present invention does not fracture as easily as bronze under the lateral forces of the fillet rolling process.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENT

Figure 1:
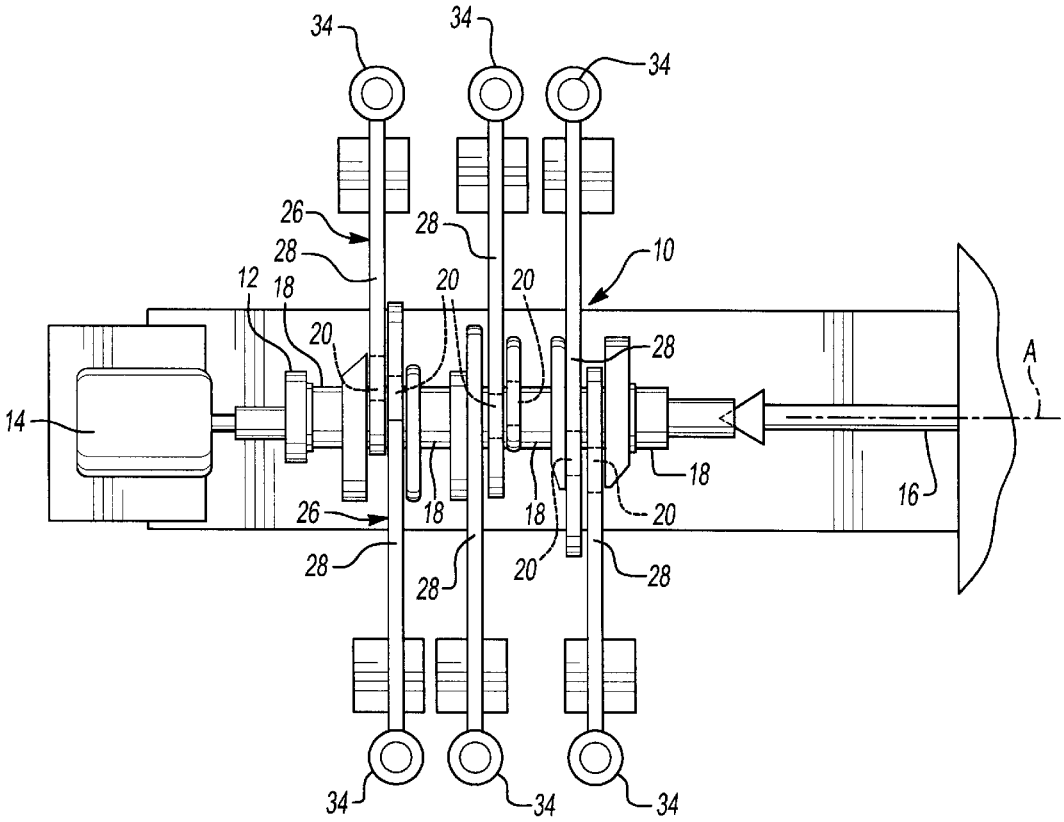
FIG. 1 is a top elevational view of a fillet rolling machine.

A fillet rolling assembly 10 is shown in FIG. 1 for deep rolling fillets of work pieces such as a crankshaft 12. The crankshaft 12 is supported in the fillet rolling assembly 10 by a headstock with a drive motor 14 and a tailstock 16. The drive motor 14 drives the crankshaft about an axis A to deep roll the journal fillets. The crankshaft 12 includes main journals 18 and pin journals 20 that are spaced from the axis A.

Figure 2:
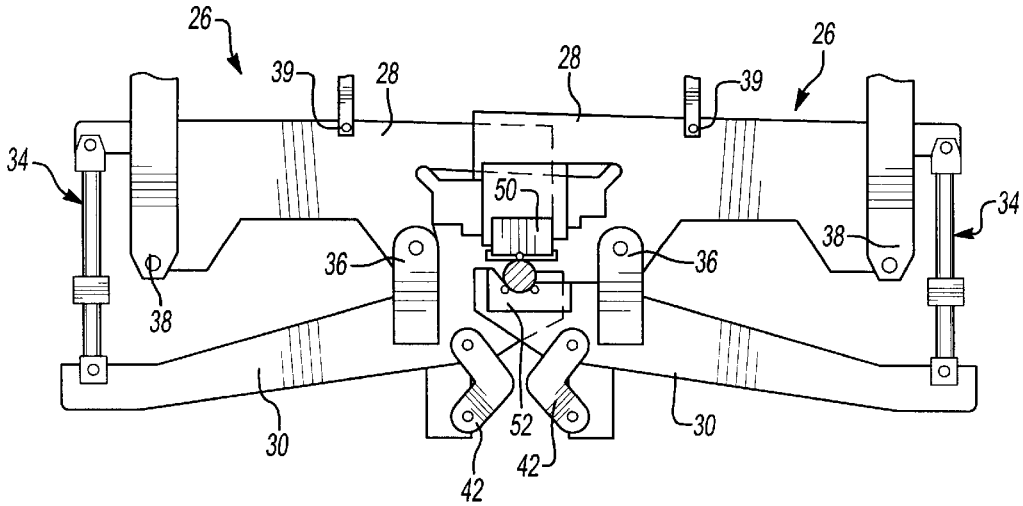
FIG. 2 is a side elevational view of the fillet rolling machine.

Referring to FIGS. 1 and 2, the fillet rolling assembly 10 includes jaw assemblies 26 that have an upper jaw 28 and a lower jaw 30 pivotally connected by a clevis 36. A hydraulic actuator 34 is disposed between ends of the upper 28 and lower 30 jaws to close the opposite end of the jaw assemblies 26 together to deep roll the journal fillets. The jaw assemblies 26 are suspended within the fillet rolling assembly 10 by upper supports 38, 39, for moving the jaw assemblies 26 toward and away from the crankshaft 12 as the crankshafts 12 are loaded and unloaded from the fillet rolling assembly 10. The lower jaw 30 of the jaw assembly 26 is pivotally connected to the fillet rolling assembly 10 by a linkage 42 which is used to limit lateral movement of the jaw assemblies 26. As the crankshaft 12 is driven about axis A, the jaw assemblies 26 orbit about the axis A and deep roll the journal fillets.

Figure 3:
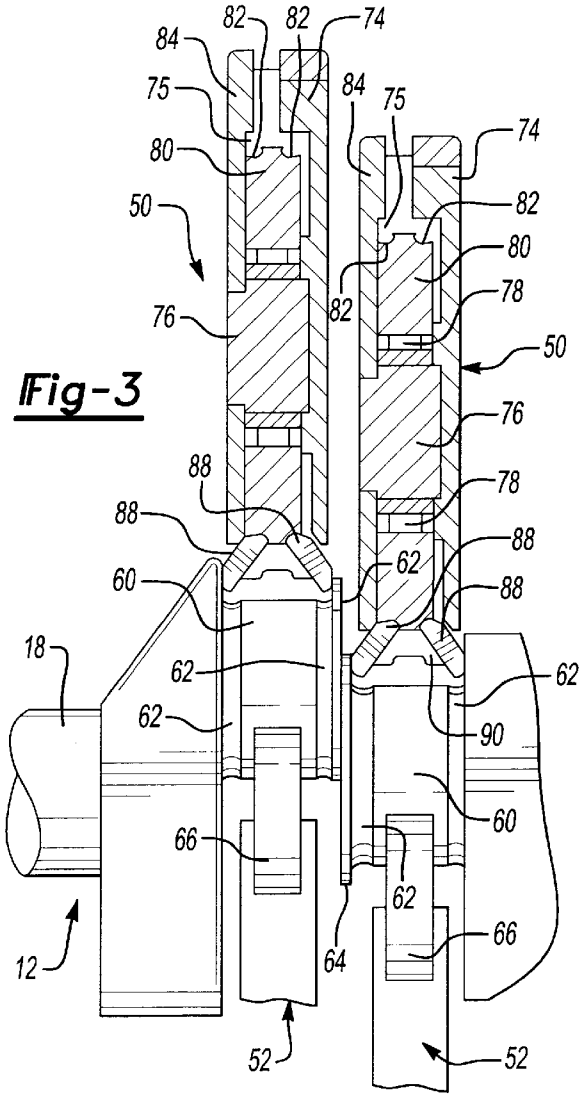
FIG. 3 is a sectional view of the fillet rolling tools used in deep rolling journal fillets.

The upper 28 and lower 30 jaws respectively include upper 50 and lower 52 work tools. The lower tool 52 includes a pair of support roller 66 that engage and support a bearing surface 60 of a journal of a crankshaft, as shown in FIG. 3. Each journal typically includes a shoulder 64 and a fillet 62 arranged between the shoulder 64 and the bearing surface 60. The main journals 18 are received within the engine block to support the crankshaft 12 for rotation about axis A within the engine. Connecting rods are secured to the pin journals 20 for transferring force from the pistons to rotate the crankshaft 12 about axis A within the engine. The crankshafts 12 are typically cast of iron and include stress concentrations in the area of the fillets 62. Deep rolling the fillets 62 relieves the stress in the area of the fillets 62 so that the crankshaft 12 will not fracture during normal engine operation.

Upper tool 50 includes a housing 74 that has a cavity 75. A backup roller 80 is received within the cavity 75 and is supported on a shaft 76 having needle bearings 78 disposed thereabout. A side plate 84 is secured to the housing 74 to retain the backup roller 80 within the cavity 75. The backup roller 80 includes an annular groove 82 that receive work rollers 88 for bearing the load during the deep rolling process. For the upper tool 50 shown in the Figures, two work rollers 88 are shown for rolling two fillets 62 for a journal. For a journal having only one fillet 62 to be rolled, the backup roller 80 need only have one annular groove 82 for receiving a single work roller 88.

Figure 4:
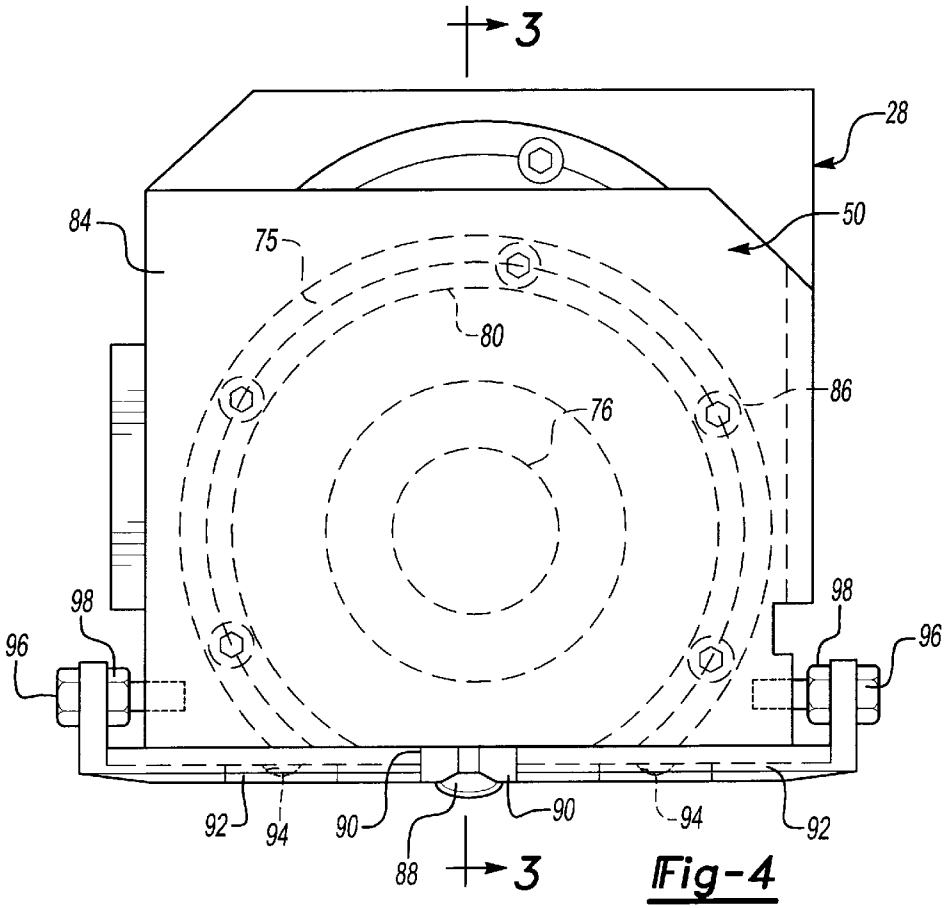
FIG. 4 is a side elevational view of an upper fillet rolling tool.

A pair of opposing cages 90 receive and locate the work rollers 88 relative to the backup roller 80, as best shown in FIG. 4. The cages 90 are secured to the housing 74 by adjustable cage retainers 92. The cage retainers 92 include adjustment screws 96 for adjusting the cage retainers 92 along the bottom portion of the housing 74. Once the location of the cage retainers 92 and the cages 90 has been positioned in a desirable location, fasteners 94 secure the cage retainers 92 to the housing 74. The fasteners 94 are received within apertures 93 of the cage retainers 92. Adjustment nuts 98 cooperate with the adjustment screws 96 to locate the cage retainers 92.

Figure 5:
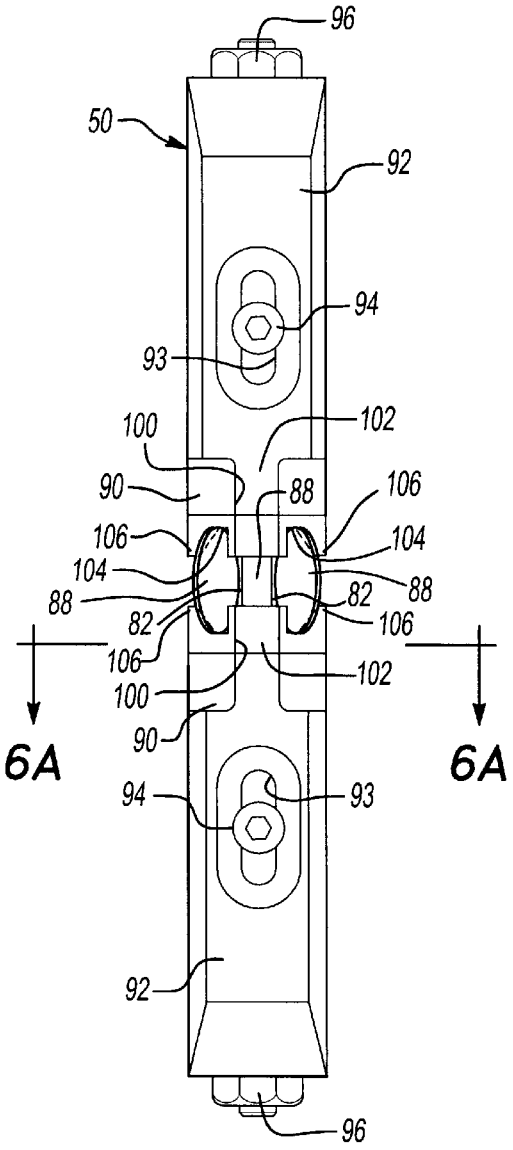
FIG. 5 is a bottom elevational view of the upper fillet rolling tool of FIG. 4.
Figure 6A:
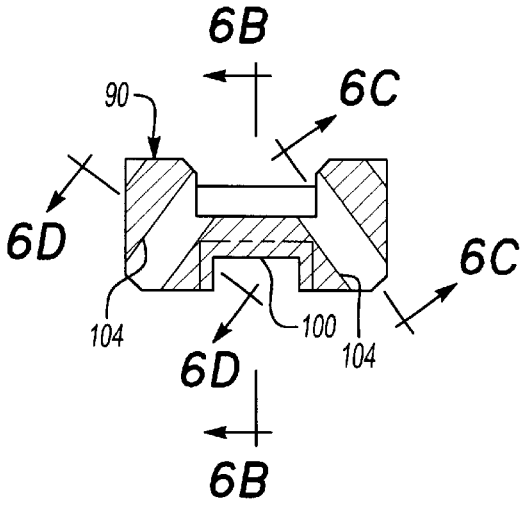
FIG. 6A is a cross-sectional view of a cage taken along lines 6A—6A of FIG. 5.
Figure 6B:
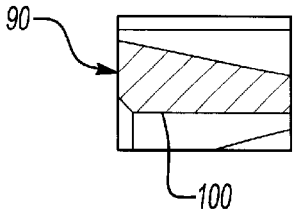
FIG. 6B is a cross-sectional view of the cage shown in FIG. 6A taken along line 6B—6B.
Figure 6C:
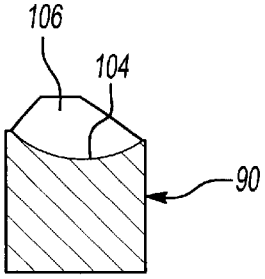
FIG. 6C is a cross-sectional view of the cage shown in FIG. 6A taken along line 6C—6C.
Figure 6D:
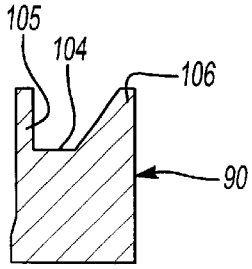
FIG. 6D is a cross-sectional view of the cage shown in FIG. 6A taken along line 6D—6D.

Referring to FIG. 5, the cages 90 include channels 100 that are received by guides 102 that extend from the cage retainers 92. The cages 90 include annular recesses 104 that receive the work rollers 88. The annular recesses 104 are best shown in FIGS. 6C and 6D. The cage 90 includes an inner wall 105 and an outer wall 106 that define the annular recess 104. As discussed above, the crankshaft 12 moves laterally along axis A during the deep rolling process due to the tolerances in the crankshaft and the play in the fillet rolling machine 10. This lateral movement has caused fracture of the outer wall 106 for prior art designs using bronze cages. Bronze cages have been used for many decades. The present invention utilizes a polymer cage 90 to prevent fracture of the outer wall 106. Preferably, a thermal plastic material is used such as high density polyethylene. Even more preferably, a thermoplastic material such as ultra high molecular weight polyethylene is used. One such ultra high molecular weight polyethylene material is sold under the trade name GAR-DUR by Garland Manufacturing Company in Sako, Me. The ultra high molecular weight polyethylene provides superior ductility, impact strength, and wear resistance to that of bronze. Additionally, the ultra high molecular weight polyethylene material has a lower co-efficient of friction and increased abrasion resistance. By utilizing the polymer cage of the present invention, fracture of the cages may be avoided and increased run time of the fillet rolling machines and productivity may be appreciated. Ultra high molecular weight polyethylene such as GAR-DUR also provide chemical stability required in harsh environments utilizing lubricating fluids.

The invention has been described in an illustrative manner, and it is to be understood that the terminology that has been used is intended to be in the nature of words of description rather than of limitation. Obviously, many modifications and variations of the present invention are possible in light of the above teachings. It is, therefore, to be understood that within the scope of the appended claims the invention may be practiced otherwise than as specifically described.

What is claimed is:

1. A fillet rolling tool for deep rolling journal fillets comprising:

a housing assembly having a cavity;

a back up roller having an annular groove, said back up roller disposed in said cavity and rotatably supported by said housing assembly;

a work roller received in said annular groove for deep rolling journal fillets; and at least one cage having an arcuate recess receiving said work roller said cage including an outer wall defining a portion of said arcuate recess, and said cage constructed from a polymer.

2. The fillet rolling tool according to claim 1, wherein said polymer is a thermoplastic.

3. The fillet rolling tool according to claim 2, wherein said thermoplastic is a high density polyethylene.

4. The fillet rolling tool according to claim 2, wherein said thermoplastic is an ultra high molecular weight polyethylene.

5. The fillet rolling tool according to claim 1, wherein said polymer includes a ductility greater than bronze ductility.

6. The fillet rolling tool according to claim 1, wherein said polymer includes an impact strength greater than bronze impact strength.

7. The fillet rolling tool according to claim 1, wherein said polymer includes a wear resistance greater than bronze wear resistance.

8. A work roller cage for a fillet rolling tool used in deep rolling journal fillets comprising:

a polymer structure having a top portion with a first groove and bottom portion spaced from said top portion with a second groove opposite said first groove; and an arcuate recess extending though said top and bottom portions with said recess spaced from first groove and intersecting said second groove, and said recess defined by spaced apart inner and outer walls respectively including inner and outer surfaces at an angle relative to one another for at least partially receiving a work roller.

9. The work roller cage according to claim 8, wherein said polymer is a thermoplastic.

10. The work roller cage according to claim 9, wherein said thermoplastic is a high density polyethylene.

11. The work roller cage according to claim 9, wherein said thermoplastic is an ultra high molecular weight polyethylene.

12. The work roller cage according to claim 8, wherein said polymer includes a ductility greater than bronze ductility.

13. The work roller cage according to claim 8, wherein said polymer includes an impact strength greater than bronze impact strength.

14. The work roller cage according to claim 8, wherein said polymer includes a wear resistance greater than bronze wear resistance.

15. The work roller cage according to claim 8, further including a second recess extending though said top and bottom portions with said recess spaced from first groove and intersecting said second groove, said recesses angled toward one another and symmetrical about said second groove.

16. The work roller cage according to claim 8, wherein said second groove is angled toward said recess.

* * * * *